US011369189B2

(12) United States Patent
Carnevali

(10) Patent No.: US 11,369,189 B2
(45) **Date of Patent: *Jun. 28, 2022**

(54) COMBINATION STRAP AND STAND SUPPORT FOR TABLETS AND HAND HELD ELECTRONIC DEVICES

(71) Applicant: National Products, Inc., Seattle, WA (US)

(72) Inventor: Jeffrey D. Carnevali, Seattle, WA (US)

(73) Assignee: National Products, Inc., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/150,588

(22) Filed: Jan. 15, 2021

(65) Prior Publication Data

US 2021/0127819 A1 May 6, 2021

Related U.S. Application Data

(63) Continuation of application No. 16/774,742, filed on Jan. 28, 2020, now Pat. No. 10,905,227, which is a (Continued)

(51) Int. Cl.

| | |
|---|---|
| ***A45F 5/10*** | (2006.01) |
| *A45C 11/00* | (2006.01) |
| *A45F 5/00* | (2006.01) |

(52) U.S. Cl.

CPC ..... *A45F 5/10* (2013.01); *A45C 2011/003* (2013.01); *A45C 2200/15* (2013.01); *A45F 2005/008* (2013.01); *A45F 2200/0525* (2013.01)

(58) Field of Classification Search

CPC ..... A45F 5/10; A45F 2005/002; A45F 2005/1013; A45F 2200/0516;

(Continued)

(56) References Cited

U.S. PATENT DOCUMENTS 8,070,026 B2 12/2011 Wadsworth et al.
8,382,059 B2 * 2/2013 Le Gette ..... H04R 1/1033 248/460

(Continued)

FOREIGN PATENT DOCUMENTS

WO 2012/087371 6/2012

OTHER PUBLICATIONS

Official Communication for U.S. Appl. No. 14/790,980 dated Aug. 12, 2016.

(Continued)

*Primary Examiner* — Nathan J Newhouse

*Assistant Examiner* — Matthew T Theis

(74) *Attorney, Agent, or Firm* — Branch Partners PLLC; Bruce E. Black

(57) ABSTRACT

A support for a portable electronic device, the support having a case that is configured to receive and hold the portable electronic device. A strap is coupled to the case and configured for fitting around an appendage of a user and allowing the user to support the case relative to the appendage. A support stand is coupled to the case independently of the strap and includes a portion that is swivelable away from the case and is configured, when swiveled away from the case, for supporting the case on an external surface in an angled arrangement relative to the external surface. Optionally, the base is positioned on a back plane of the case, and a rotational mechanism is coupled between the base and the case such that the case is rotatable relative to the base.

20 Claims, 14 Drawing Sheets

Related U.S. Application Data continuation of application No. 14/790,980, filed on Jul. 2, 2015, now Pat. No. 10,595,622.

(58) Field of Classification Search

CPC ..... A45F 2005/008; A45F 5/00; A45F 2200/0525; A45C 2200/15; A45C 2011/003; F16M 11/10; F16M 11/105; F16M 2200/021; F16M 11/041; F16M 11/04; H05K 5/023; H04M 1/04; G06F 1/1628

USPC ..... 224/218, 577

See application file for complete search history.

(56) References Cited

U.S. PATENT DOCUMENTS

| | | | | |
|---|---|---|---|---|
| 8,605,431 | B2 | 12/2013 | Cheng et al. | |
| 8,662,362 | B1 | 3/2014 | Bastian et al. | |
| 9,016,645 | B2 * | 4/2015 | Simpson | F16M 13/02 248/278.1 |
| 9,074,725 | B2 | 7/2015 | Trotsky | |
| 9,137,915 | B2 | 9/2015 | McCurdy | |
| D756,366 | S | 5/2016 | Floersch et al. | |
| 10,595,622 | B2 * | 3/2020 | Carnevali | A45F 5/10 |
| 10,905,227 | B2 * | 2/2021 | Carnevali | A45F 5/10 |
| 2011/0279959 | A1 * | 11/2011 | Lopez | A45F 5/00 361/679.03 |
| 2012/0025684 | A1 | 2/2012 | Trotsky | |
| 2012/0111881 | A1 | 5/2012 | Gaddis, II et al. | |
| 2013/0001382 | A1 | 1/2013 | Jang | |
| 2013/0299365 | A1 | 11/2013 | Andrew | |
| 2013/0300141 | A1 | 11/2013 | Byrne | |
| 2014/0077515 | A1 * | 3/2014 | Rasmussen | A45F 5/102 294/169 |
| 2014/0299488 | A1 | 10/2014 | Andrew | |

OTHER PUBLICATIONS

Official Communication for U.S. Appl. No. 14/790,980 dated Feb. 22, 2017.

Official Communication for U.S. Appl. No. 14/790,980 dated Jun. 14, 2017.

Official Communication for U.S. Appl. No. 14/790,980 dated Dec. 27, 2017.

Official Communication for U.S. Appl. No. 16/774,742 dated Sep. 17, 2020.

* cited by examiner

Fig. 9
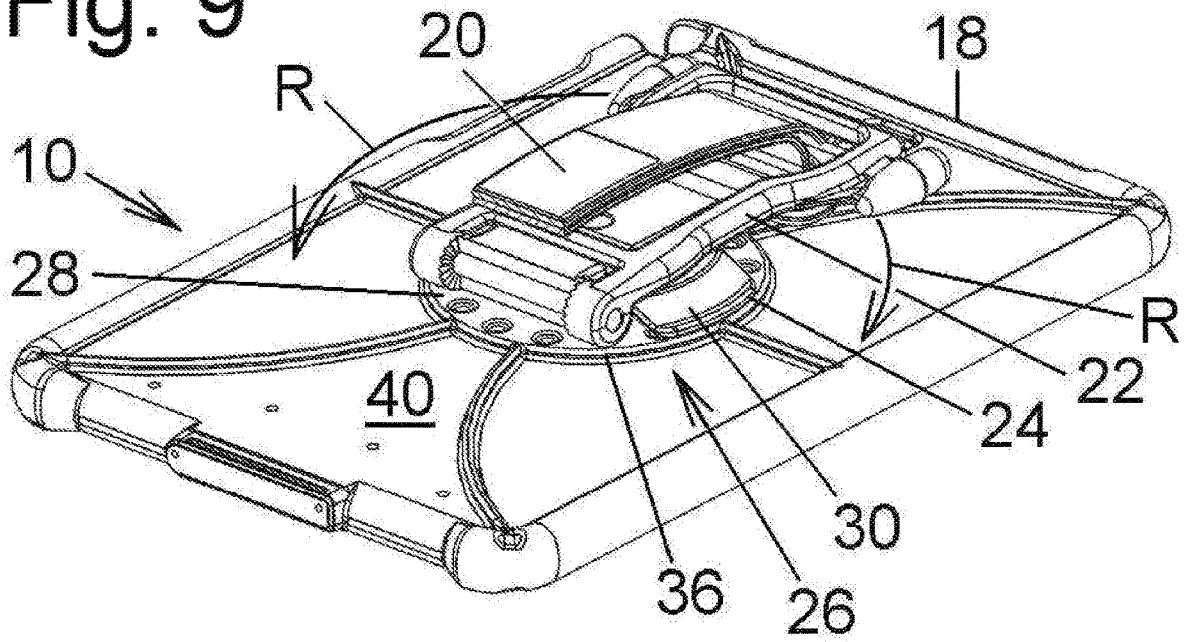
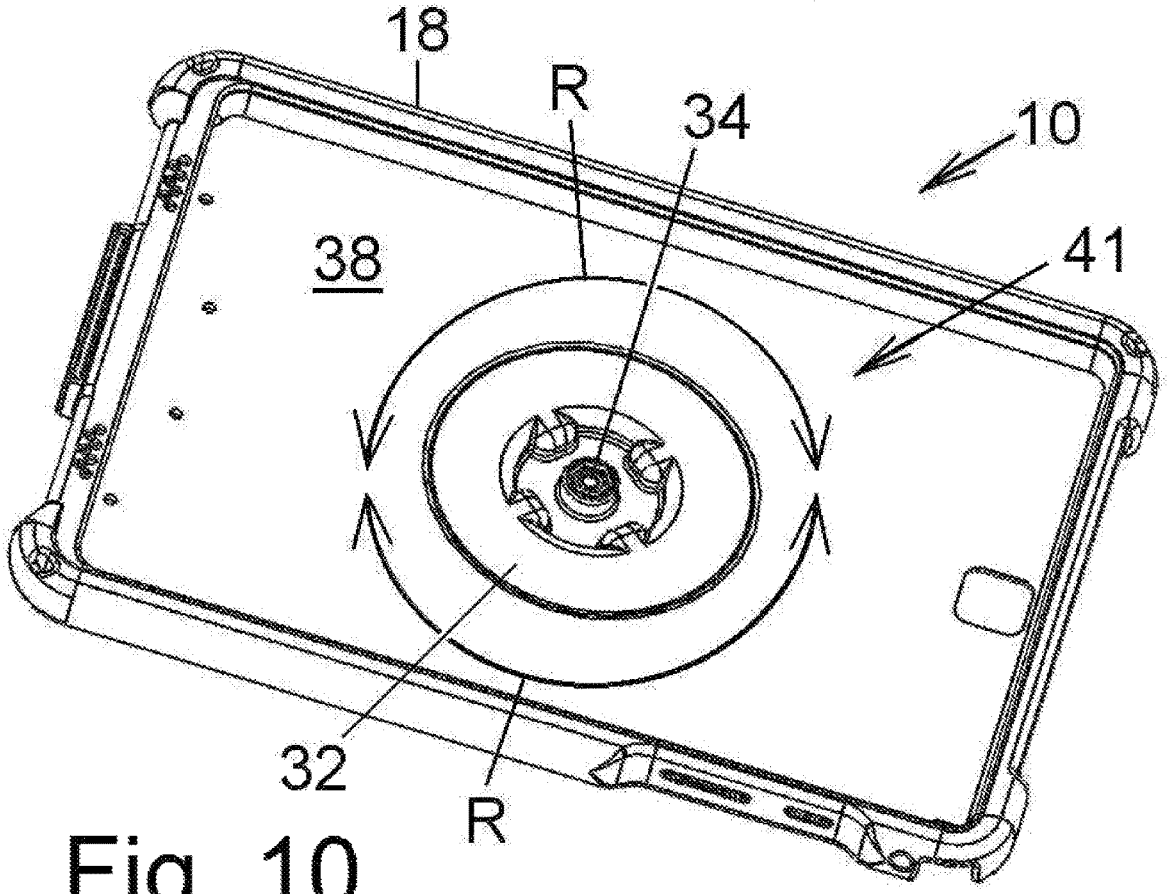
Fig. 10

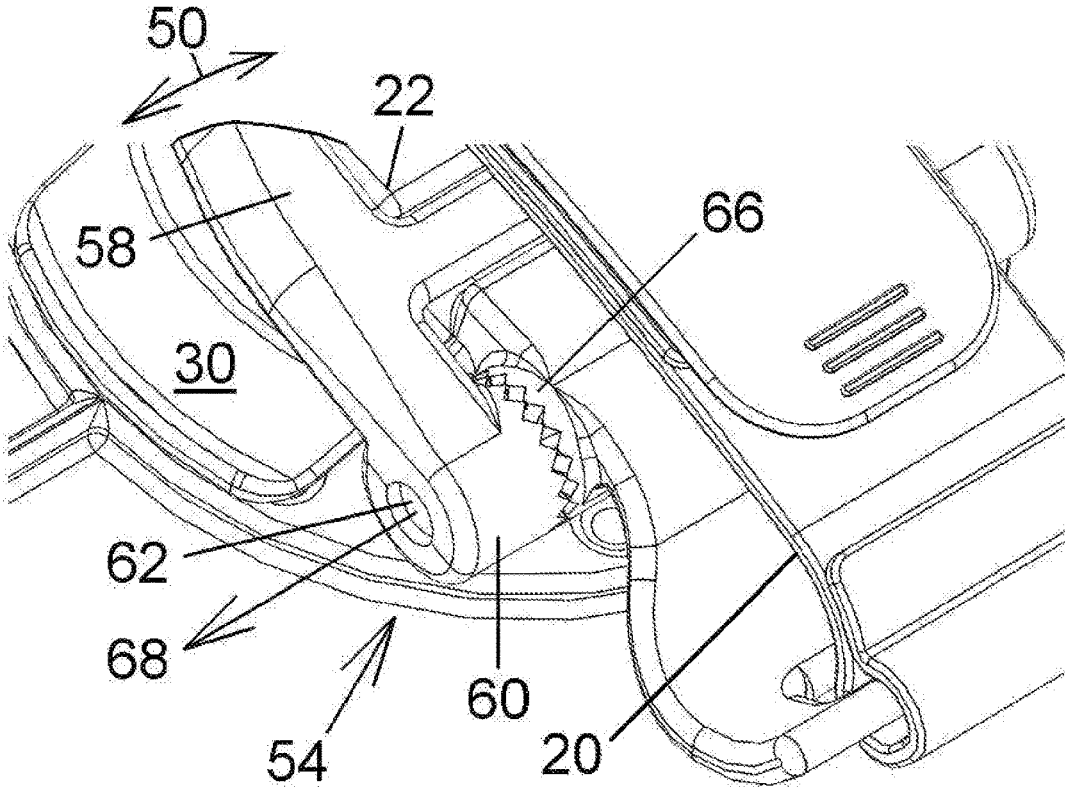
Fig. 15
Fig. 16
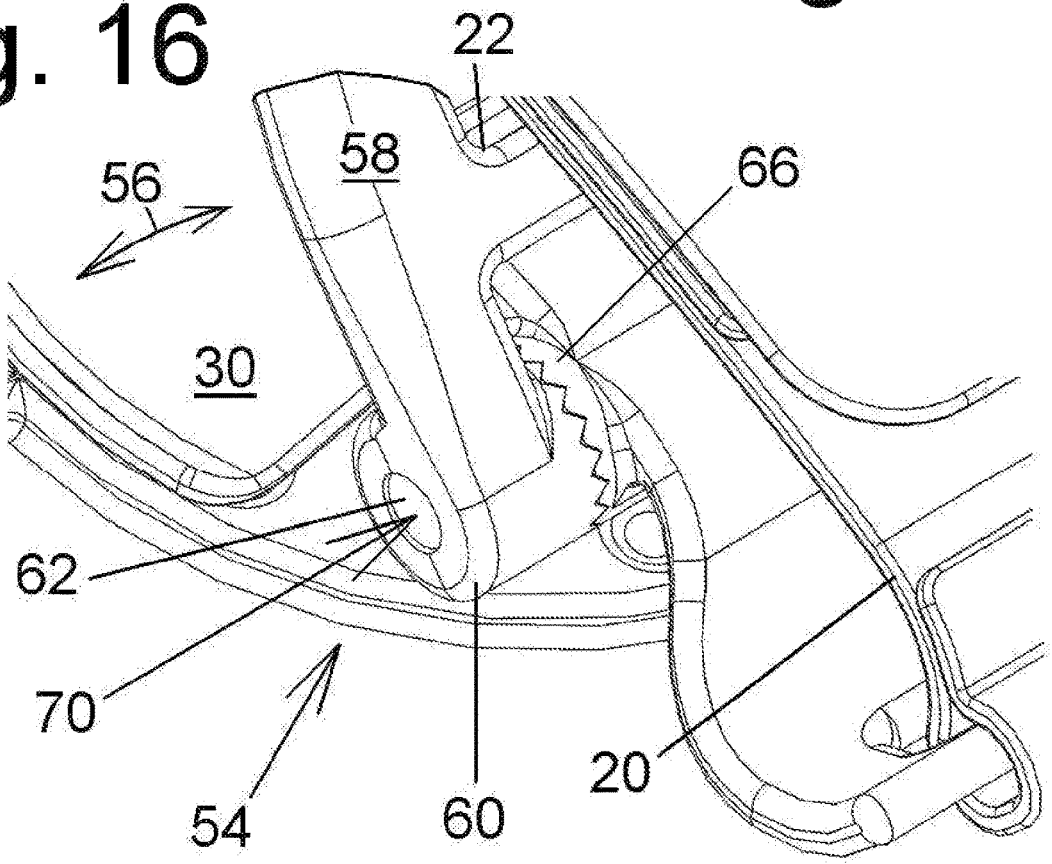

COMBINATION STRAP AND STAND SUPPORT FOR TABLETS AND HAND HELD ELECTRONIC DEVICES

CROSS-REFERENCE TO RELATED APPLICATIONS

This patent application is a continuation of U.S. patent application Ser. No. 16/774,742, filed Jan. 28, 2020, which issued as U.S. Pat. No. 10,905,227, which is a continuation of U.S. patent application Ser. No. 14/790,980, filed Jul. 2, 2015, which issued as U.S. Pat. No. 10,595,622, both of which are incorporated herein by reference.

FIELD OF THE INVENTION

The present invention relates generally to a support for a portable electronic device, and in particular to a combination hand-strap and fixed stand for both tablets and other handheld portable electronic devices.

BACKGROUND OF THE INVENTION

Handheld portable electronic device are generally well-known. Some electronic devices, such as tablets and cellular telephones, are able to rotate their display between a portrait view and landscape view. These and other portable electronic devices are often mounted in a protective case, some cases have arm or wrist bands that allow the electronic device to be carried on the user's arm for convenience and easy access. Stands are also known for supporting the electronic device on a external fixed surface, such as a desk or table top, or a automobile windscreen or dashboard.

However, known arm bands, wrist bands and surface stands are limited in their ability to provide flexibility of either supporting on an external fixed surface, or mounting on a user's appendage such as a hand, wrist or arm.

SUMMARY OF THE INVENTION

The present invention is a support for a portable electronic device that overcomes limitations of the prior art for supporting electronic devices, such as tablets and cellular telephones, either on a fixed surface of an inanimate object external of the device, such as a desk or table top, or a automobile console or dashboard, or on an appendage of a user.

Furthermore, the support of the invention is useful for operation with devices that are able to rotate their display between a portrait view and landscape view.

According to one aspect of the invention, the support provides a protective case configured to receive and protectively hold the portable electronic device. A strap is coupled to the case and is configured for fitting around an appendage, such as a hand, wrist or forearm, of a user and allowing the user to support the case relative to the appendage. A support stand is coupled to the protective case independently of the strap and includes a portion that is swivelable away from the case and is configured, when swiveled away from the case, for supporting the case on an external surface in an angled arrangement relative to the external surface.

According to another aspect of the invention, the support of the invention includes a swivel mechanism between the support stand and the base for swiveling the stand within a range of fixed deployment angles relative to the base.

According to another aspect of the invention, the support of the invention includes a rotational mechanism that is coupled for relative rotation between the base and the case.

According to another aspect of the invention, the rotational mechanism is interlockable for fixing an orientation of the case relative to the base.

According to another aspect of the invention, the support of the invention includes a resiliently flexible frame between the base and the strap. Optionally, when the support of the invention includes a resiliently flexible frame between the base and the strap, the strap is substantially inelastic.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 9 illustrates the combination hand-strap and fixed stand support of FIG. 1, wherein the interlocking rotational mechanism is illustrated for rotating the protective case of the support between the portrait and landscape modes and one or more intermittent angular orientations between the portrait and landscape orientations;

FIG. 10 illustrates the combination hand-strap and fixed stand support of FIG. 1, wherein the interlocking rotational mechanism is coupled to the protective case in a manner that permits rotation between the portrait and landscape orientations;

FIG. 13 and FIG. 14 each illustrates the combination strap and fixed stand support of FIG. 1, FIG. 13 and FIG. 14 together illustrate deployment of the stand for supporting the electronic device on an external fixed surface (FIG. 3 and FIG. 4), wherein FIG. 13 shows the stand in a stowed position in a retracted state against an exterior of a back plane of the case, and FIG. 14 shows the stand being deployed into an extended state that is spaced away from the exterior of the back plane of the case;

FIG. 15 and FIG. 16 each illustrates the combination strap and fixed stand support of FIG. 1, FIG. 15 and FIG. 16 together illustrate operation of one exemplary embodiment of a swivel mechanism that permits the stand to swivel between the stowed position (FIG. 13) and the deployed position (FIG. 14), wherein FIG. 15 illustrates mating toothed members operating as a two-directional ratchet mechanism during swiveling with mating inclined teeth toothed members sliding over one another, and FIG. 16 illustrates interlocking engagement of mating toothed members whereby the stand is rotationally fixed at a selected deployment angle;

FIG. 17, FIG. 18 and FIG. 19 each illustrates the combination strap and fixed stand support of FIG. 1, wherein FIG. 17 illustrates the strap fitted to a frame with a curved or 'bow' shape, such as a reentrant curve as shown, FIG. 18 illustrates the frame being flexed for receiving a user's appendage thereinto, and FIG. 19 illustrates the user's appendage received into a loop formed between the strap and the flexed frame.

DETAILED DESCRIPTION OF PREFERRED EMBODIMENT

As required, a detailed illustrative embodiment of the present protective enclosure is disclosed herein. However, techniques, systems and operating structures in accordance with the present protective enclosure may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present protective enclosure. The following presents a detailed description of an illustrative embodiment (as well as some alternative embodiments) of the present protective enclosure.

In the Figures, like numerals indicate like elements.

Figure 1:
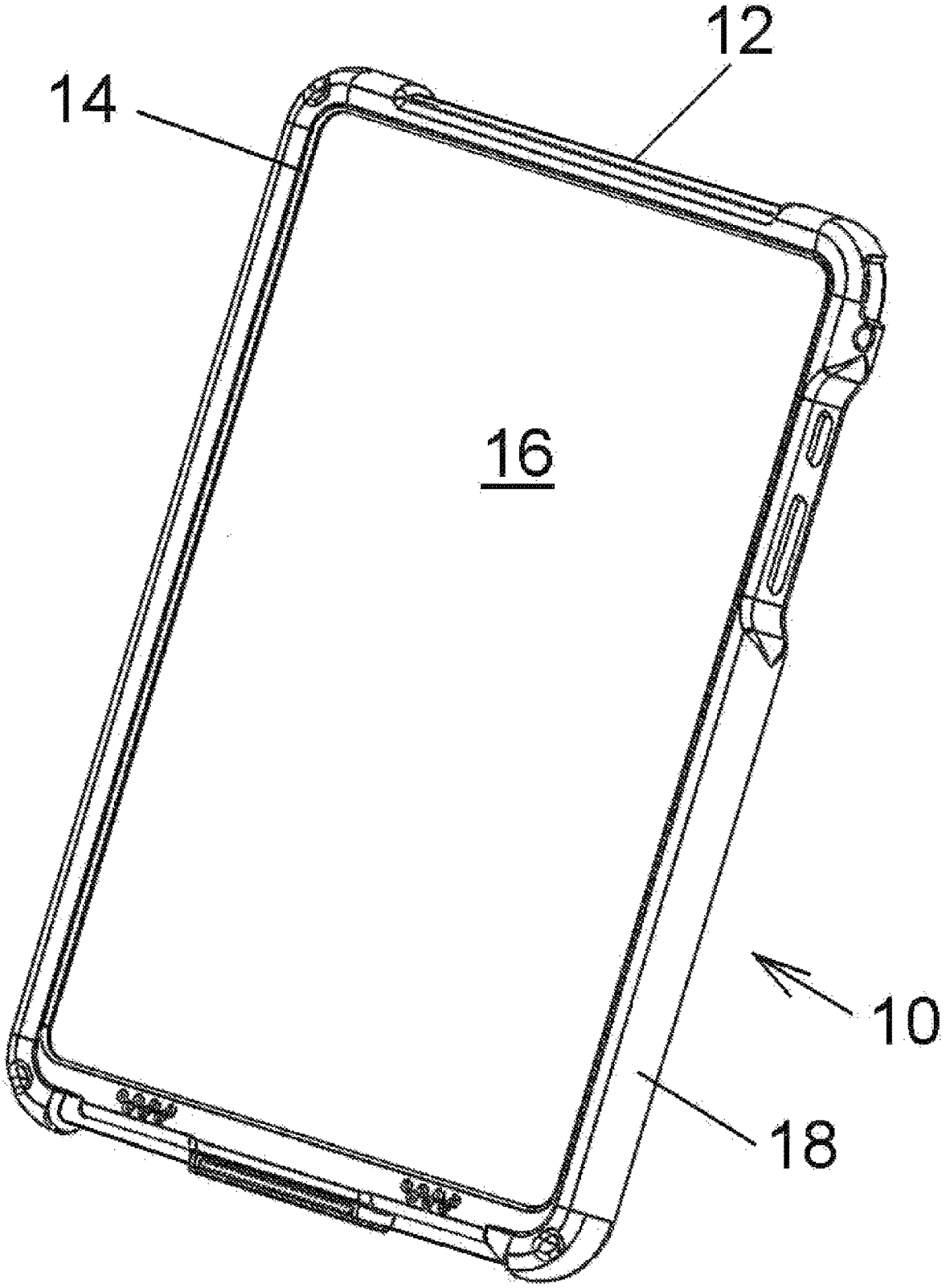
FIG. 1 illustrates the invention embodied by example and without limitation as a combination hand-strap and fixed stand support for both tablets and other handheld portable electronic devices, wherein the display of the device is rotated into a portrait view.

FIG. 1 illustrates one embodiment of the invention for a support 10 for both tablets and other handheld portable electronic devices 12, wherein support 10 includes a combination of both a hand-strap and a fixed stand.

Tablets and other handheld portable electronic devices 12 include a body 14 with a display screen 16 on one face thereof. As is generally well-known many portable electronic devices 12, such as tablets and cellular telephones, are able to rotate their display between a portrait view (shown) and landscape view (shown in FIG. 2). Accordingly, support 10 is here configured to orient device 12 with display screen 16 in a portrait mode.

Support 10 optionally includes a protective case 18 which is structured for receiving and retaining device 12 in a protective manner, while exposing operational features, such as power buttons, power adapter receptacles, volume switches, and/or camera lenses.

Figure 2:
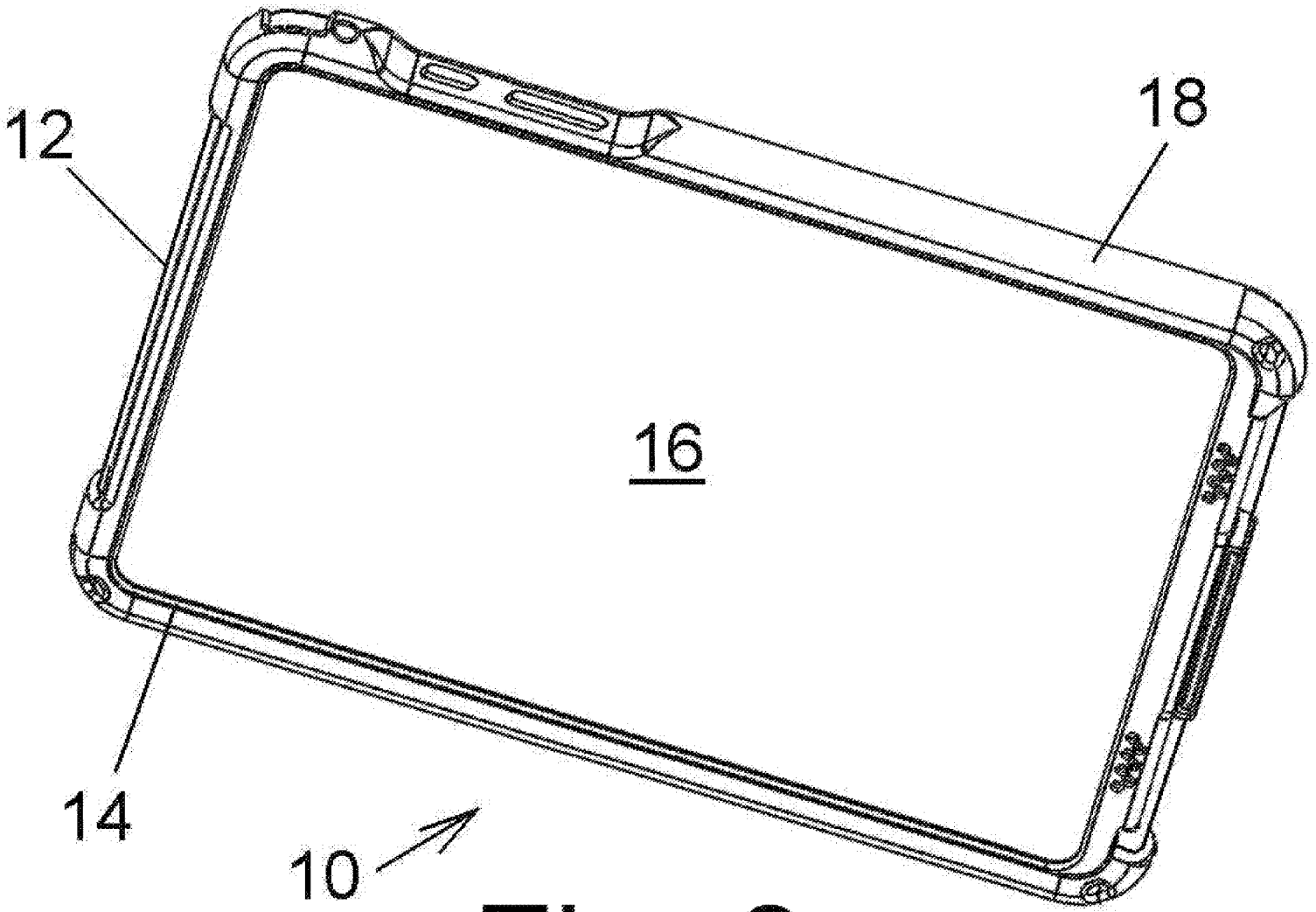
FIG. 2 illustrates the combination hand-strap and fixed stand support of FIG. 1, wherein the display of the device is rotated into a landscape view.

FIG. 2 illustrates support 10 as protective case 18 for both tablets and other handheld portable electronic devices 12, wherein the support includes a combination of both a hand-strap and a fixed stand. Here, support 10 is here configured to orient device 12 with display screen 16 in a landscape mode.

Figure 3:
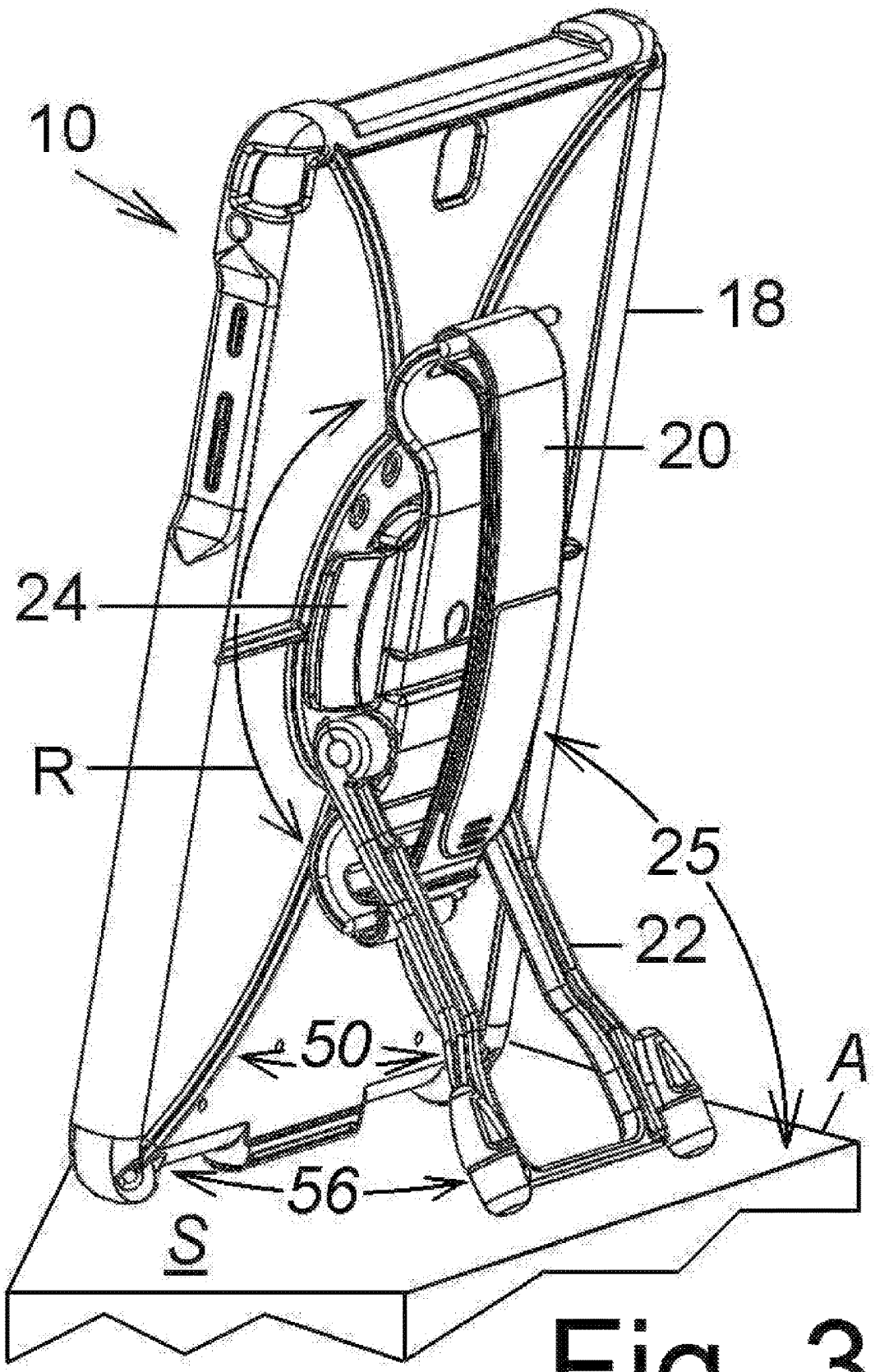
FIG. 3 illustrates the combination hand-strap and fixed stand support of FIG. 1, showing the combination hand-strap and stand, and wherein a protective case of the support is configured as a fixed stand for supporting the portable electronic device in the portrait mode.

FIG. 3 shows protective case 18 of support 10 of the invention as seen from the rear. Here, protective case 18 is configured as a fixed stand for supporting portable electronic device 12 in portrait mode on a fixed surface S of an inanimate object A that is external and independent of both device 12 and the user, such as a desk or table top, or a automobile console or dashboard. Here, by example and without limitation, protective case 18 includes a combination hand-strap 20 and support stand 22. For example, both hand-strap 20 and stand 22 are each independently coupled to a base member 24 of support 10 for operating independently. Optionally, stand 22 is swiveled, or rotated or pivoted away (arrow 50) from stowed position against case 18 into the deployed position (shown) within a range of deployment angles 56 that permit case 18 and device 12 therein to be supported in a plurality of different fixed angled arrangements 25 relative to external surface S. Base member 24 is rotatable (arrows R) about case 18 between the portrait configuration (shown) and landscape configuration (FIG. 4).

Stand 22 is structured for supporting electronic device 12 on external fixed surface S. As shown here, stand 22 is movable relative to base member 24 into a deployed position for supporting electronic device 12 on external fixed surface S.

Figure 4:
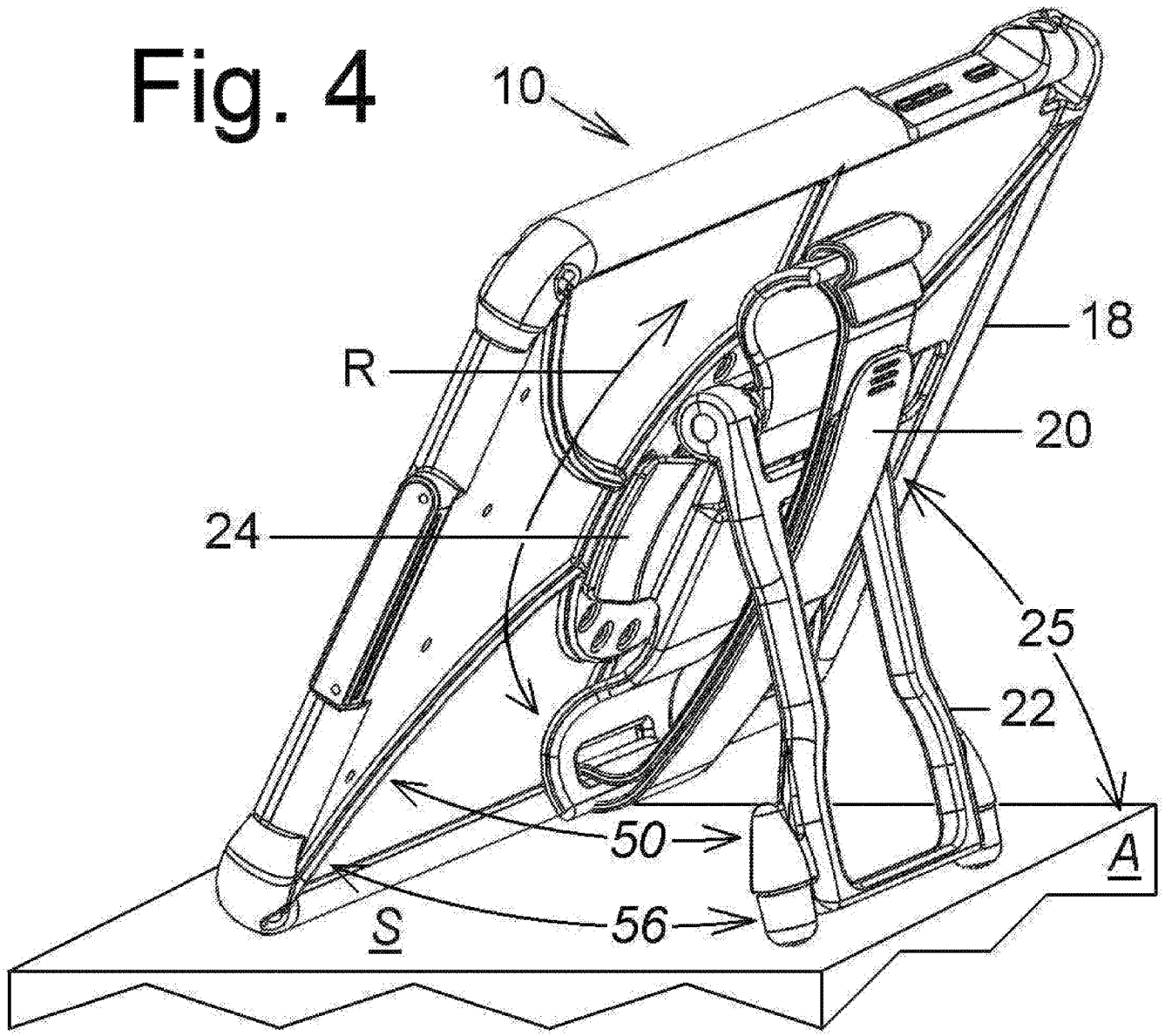
FIG. 4 illustrates the combination hand-strap and fixed stand support of FIG. 1, showing the combination hand-strap and stand, and wherein the protective case of the support is configured as a fixed stand for supporting the portable electronic device in the landscape mode.

FIG. 4 shows protective case 18 of support 10 of the invention as seen from the rear. Here, protective case 18 is configured as a fixed stand for supporting portable electronic device 12 in landscape mode on a external fixed surface S. For example, base member 24 of support 10 is rotatable at least between the portrait and landscape configurations for orienting device 12 with display screen 16 in each of the portrait and landscape modes.

Figure 5:
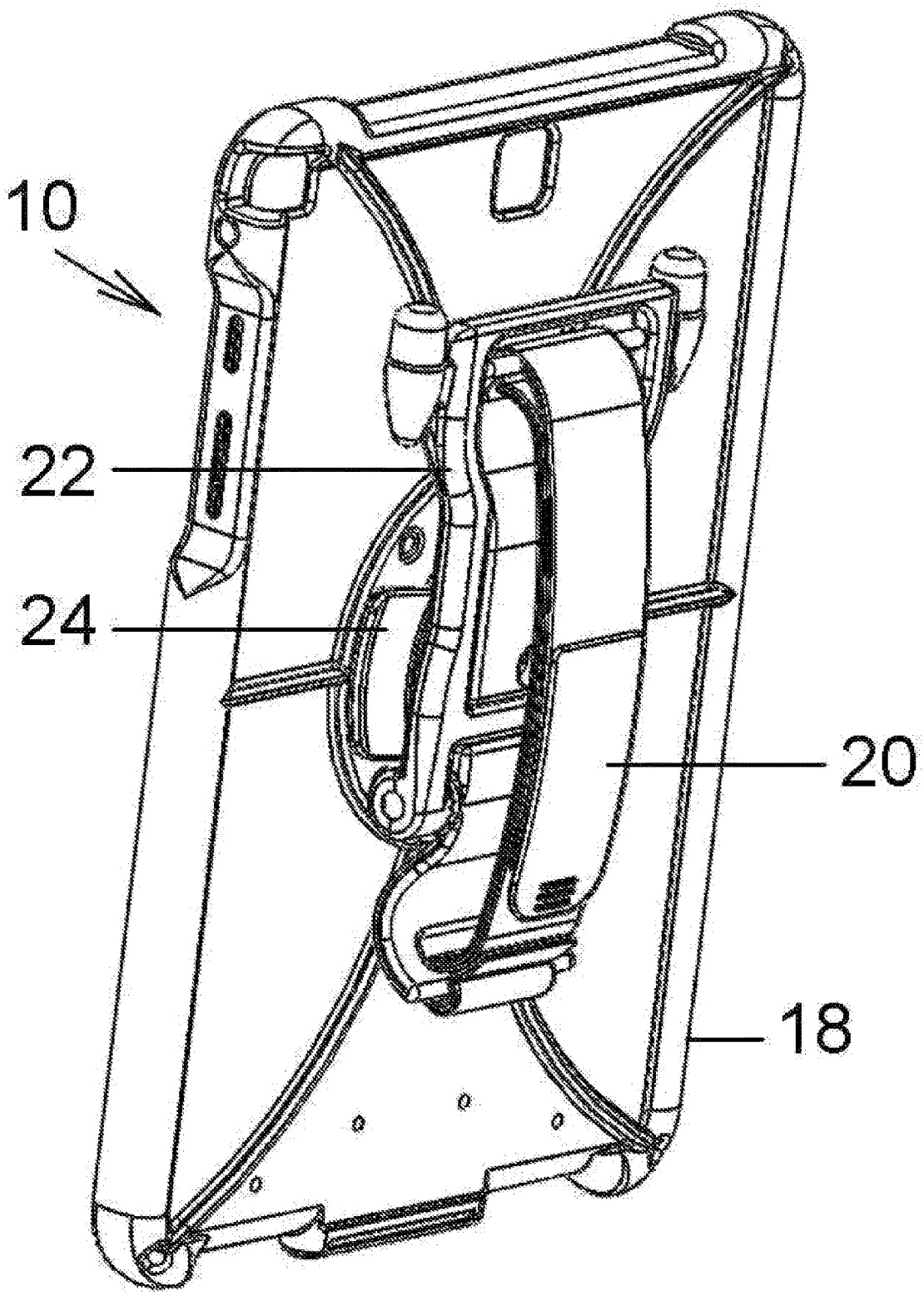
FIG. 5 illustrates the combination hand-strap and fixed stand support of FIG. 1, showing the combination hand-strap and stand, and wherein the protective case of the support is configured as a strap for supporting the portable electronic device in the portrait mode.

FIG. 5 illustrates protective case 18 of support 10 of the invention as seen from the rear. Here, protective case 18 is configured as a hand-strap for supporting portable electronic device 12 on a user's appendage, such as a hand, wrist or arm. As shown here, protective case 18 is configured in the portrait orientation for supporting device 12 in portrait mode.

Figure 6:
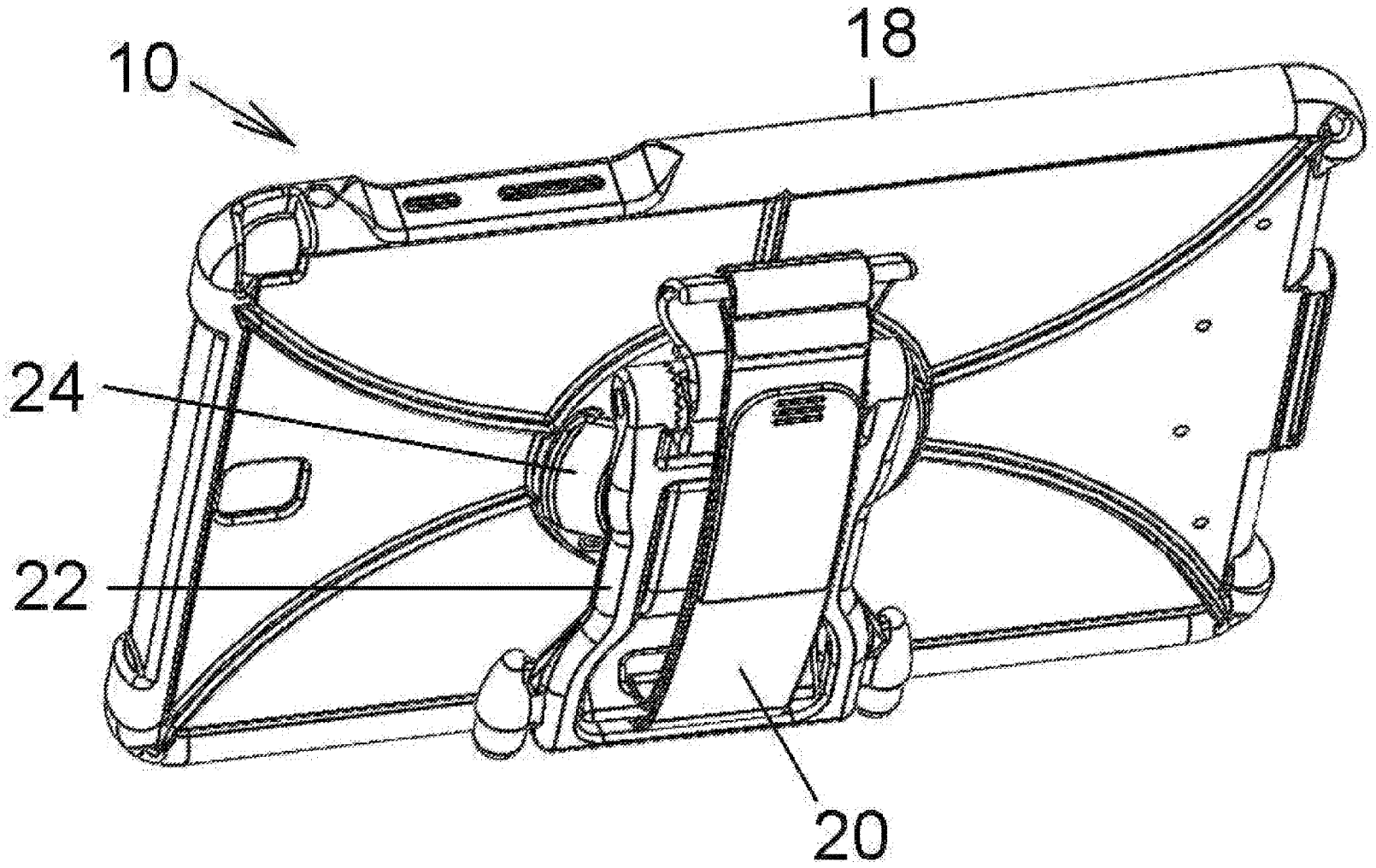
FIG. 6 illustrates the combination hand-strap and fixed stand support of FIG. 1, showing the combination hand-strap and stand, and wherein the protective case of the support is configured as a strap for supporting the portable electronic device in the landscape mode.

FIG. 6 illustrates protective case 18 of support 10 of the invention as seen from the rear, wherein protective case 18 is configured in the hand-strap mode with base member 24 configured in the portrait orientation for supporting device 12 in portrait mode.

Figure 7:
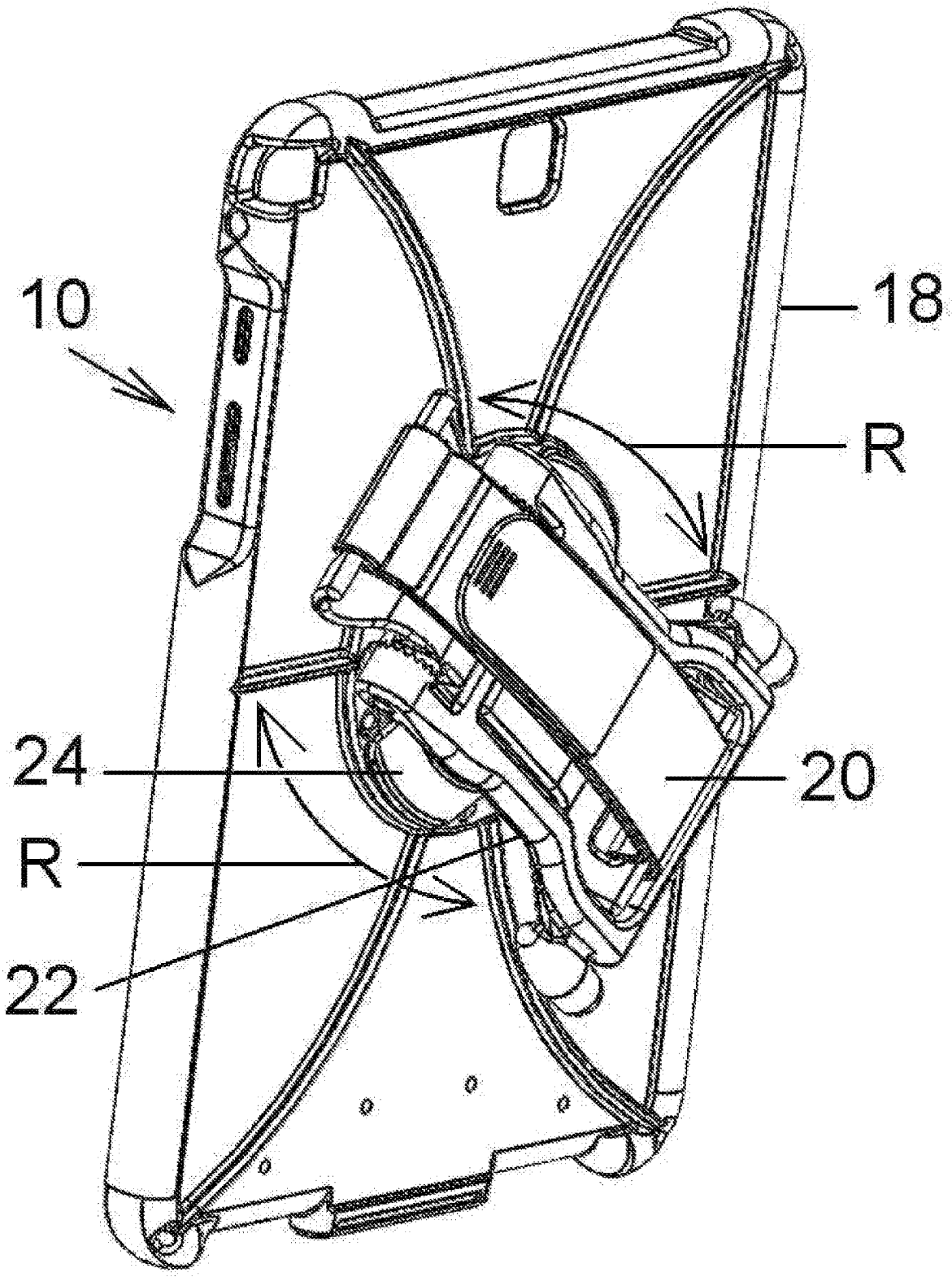
FIG. 7 illustrates the combination hand-strap and fixed stand support of FIG. 1 showing rotation of an interlocking rotational mechanism for rotating the protective case of the support between the portrait and landscape modes.

FIG. 7 illustrates protective case 18 of support 10 of the invention configured in the hand-strap mode with base member 24 rotated for configuring protective case 18 in a position between the portrait and landscape configurations. When operated in the hand-strap mode, protective case 18 is easily reoriented from the portrait to landscape configurations and back to the portrait configuration. Additionally, rotation of protective case 18 on base member 24 between the portrait to landscape configurations permits protective case 18 to pause at positions between the portrait and landscape configurations. According to one embodiment, rotation of base member 24 can be fixed in one or more positions between the portrait to landscape configurations, which permits support 10 to orient device 12 in convenient viewing orientations between the portrait to landscape modes. For example when operated in the hand-strap mode and mounted on a user's appendage such as a hand, wrist or arm, fixing rotation of base member 24 in different positions between the portrait to landscape configurations permits the user to fixedly orient device 12 in a position to conveniently view display screen 16 without requiring user to orient his or her appendage vertically or horizontally, but at a more comfortable orientation between these two extremes.

Figure 8:
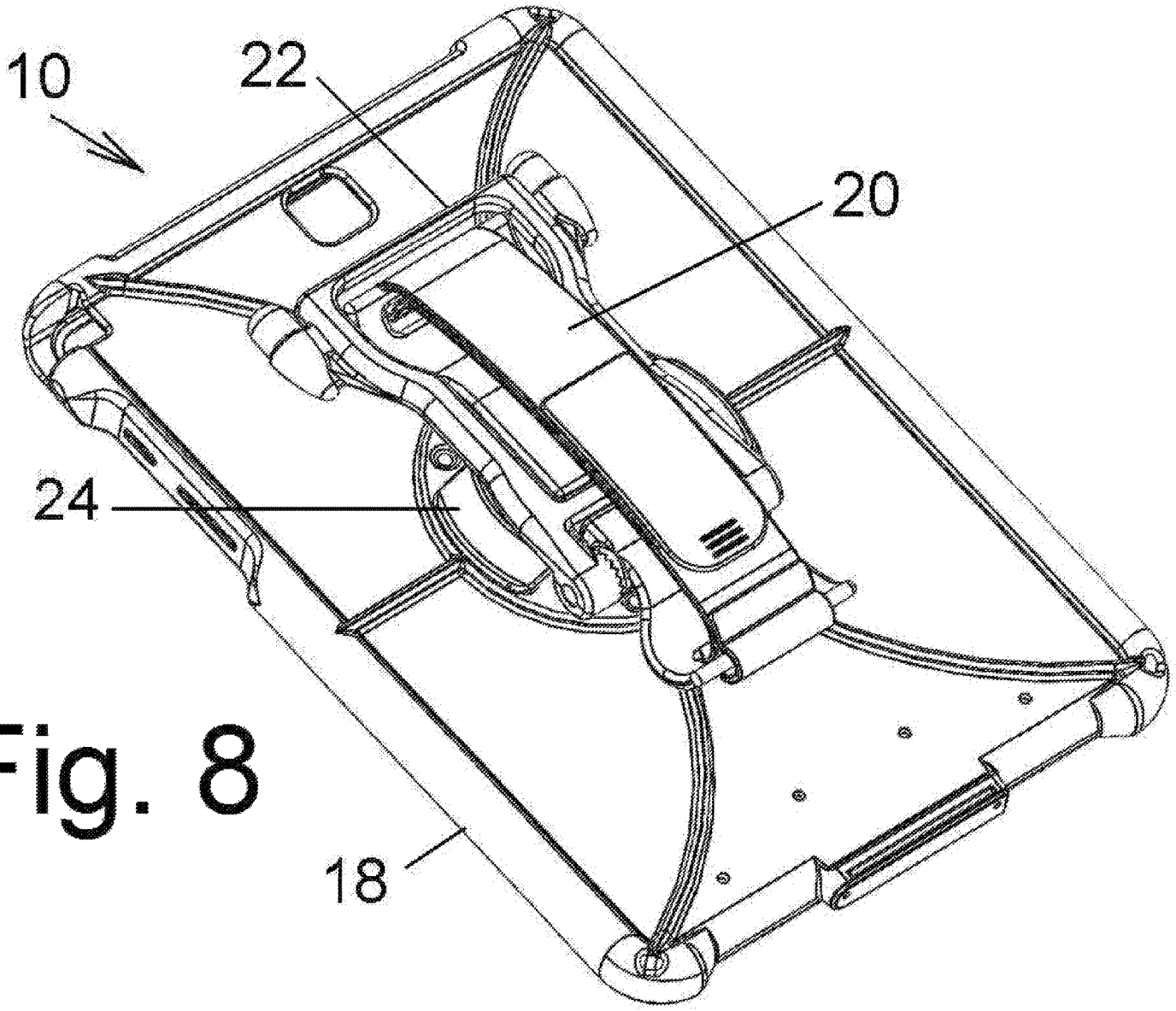
FIG. 8 illustrates the combination hand-strap and fixed stand support of FIG. 1, wherein the stand is stowed in a nonoperational state where it will not interfere with use of the strap, whereby the support is configured for operation as an appendage mount utilizing the strap on a user's hand, wrist or arm.

FIG. 8 is another view showing protective case 18 of support 10 of the invention as seen from the rear, with stand 22 stowed in a nonoperational state tucked against base member 24 where it will not interfere with use of hand-strap 20. Support 10 is thus configured for operation as an appendage mount utilizing hand-strap 20 on user's hand, wrist or arm.

FIG. 9 is another view of support 10 of the invention as seen from the rear, wherein an interlocking rotational mechanism 26 is provided for rotationally fixing protective case 18 relative to base member 24 in each of the portrait to landscape configurations, and optionally including one or more rotational orientations between the portrait to landscape configurations. According to one embodiment, interlocking mechanism 26 includes a nonrotational member 28 that is fixed relative to case 18, and a rotational member 30 that is rotationally moveable relative to nonrotational member 28.

FIG. 10 illustrates one embodiment of support 10 of the invention, wherein interlocking mechanism 26 is coupled to protective case 18. For example, a retainer 32 couples interlocking mechanism 26 to case 18 in a manner that permits rotation of rotational member 30 relative to nonrotational member 28. For example, a rotation pin 34 clamps an annular portion 36 of a back plane 38 of case 18 between retainer 32 and rotational member 30 of interlocking mechanism 26 when nonrotational member 28 is nonrotatably coupled to exterior 40 of back plane 38 of case 18, as shown in FIG. 9. Optionally, retainer 32 is a slip washer positioned interior 41 of case 18 in a manner that is rotationally slidable relative to back plane 38 of case 18.

Figure 11:
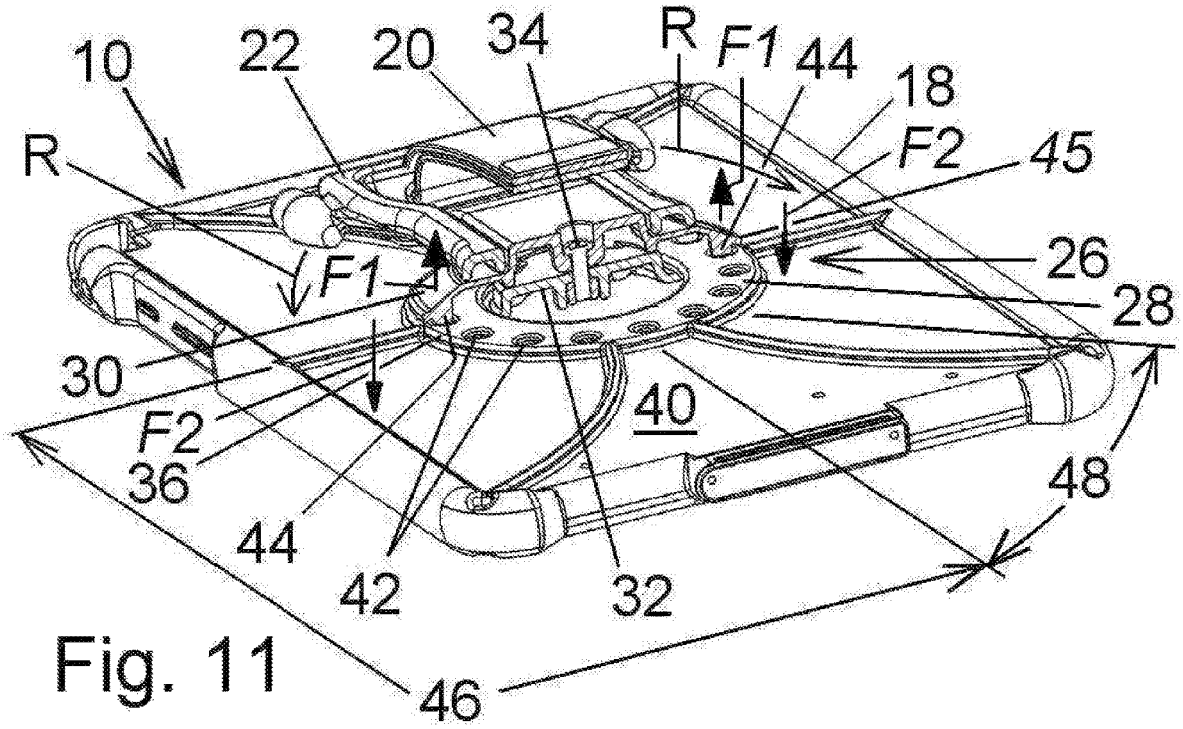
FIG. 11 illustrates the combination strap and fixed stand support of FIG. 1 showing a partial cross-section of the interlocking rotational mechanism for rotationally fixing the protective case in each of the portrait to landscape configurations.

FIG. 11 is another view of support 10 of the invention as seen from the rear showing a partial cross-section of interlocking mechanism 26 for rotationally fixing protective case 18 relative base member 24 in each of the portrait to landscape configurations. Here, interlocking mechanism 26 optionally includes an array of receivers 42 for mating teeth 44 for fixing one or more rotational orientations between the portrait and landscape configurations of protective case 18. By example and without limitation, nonrotational member 28 is formed with receivers 42, while rotational member 30 is formed with mating teeth 44.

According to one embodiment, rotational member 30 is resiliently flexible, while nonrotational member 28 is substantially rigid. During rotations (R) of interlocking mechanism 26, a peripheral skirt portion 45 of rotational member 30 resiliently flexes (arrow F1) outwardly away from nonrotational member 28 such that teeth 44 of interlocking mechanism 26 disengage from mating receivers 42 for permitting relative rotation (R) of receivers 42 and mating teeth 44 for reconfiguring case 18 between the portrait (FIG. 3) and landscape configurations (FIG. 4). For example, according to one embodiment, receivers 42 and mating teeth 44 are structured with bevels and chamfers that cooperate for forcing teeth 44 to disengage from mating receivers 42 along direction of resilient outward flexure (F1) as a result of force supplied by relative rotation (R) of receivers 42 and mating teeth 44. Alternatively, mating receivers 42 and teeth 44 are otherwise cooperatively configured to slidingly disengage and reengage, without deviating from the intent of the invention and scope of the claims. During rotations (R) of interlocking mechanism 26, teeth 44 intersect with mating receivers 42 whereupon an resilient inward flexure (arrow F2) operates automatically oppositely of resilient outward flexure (F1) to force teeth 44 to engage with mating receivers 42 to once again interlockingly engage teeth 44 with mating receivers 42 for rotationally fixing protective case 18 in either one of the portrait and landscape configurations relative to base member 24.

According to one embodiment, teeth 44 mate with receivers 42 of interlocking mechanism 26 at a plurality of different angular orientations between rotational member 30 and nonrotational member 28, including at least approximately a right angle 46 (90 Deg.) between a first and a second angular orientation for orienting protective case 18 in each of the portrait orientation (shown in FIG. 1) and the landscape orientation (shown in FIG. 2). Optionally, the plurality of different angular orientations between rotational member 30 and nonrotational member 28 may additionally include intermittent angular orientations between the portrait and landscape orientations. For example, as illustrated here, angles 48 of approximately twenty-two and one-half degrees (22½ Deg.) may be provided between adjacent receivers 42 of interlocking mechanism 26, whereby teeth 44 engage different receivers 42 for orienting rotational member 30 and nonrotational member 28 at angular intervals of approximately twenty-two and one-half degrees (22½ Deg.).

Figure 12:
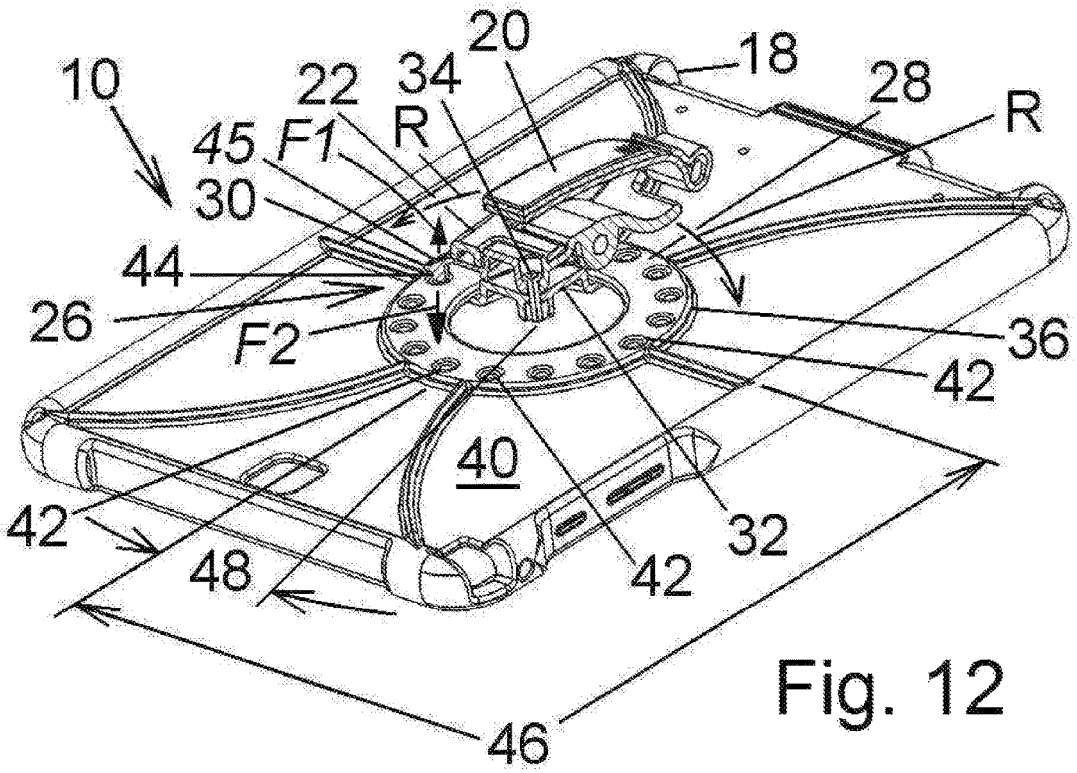
FIG. 12 is another view of the combination strap and fixed stand support of FIG. 1 showing another partial cross-section of the interlocking rotational mechanism for rotationally fixing the protective case in each of the portrait to landscape configurations.

FIG. 12 is another view of support 10 of the invention as seen from the rear showing another partial cross-section of interlocking mechanism 26 for rotationally fixing protective case 18 relative base member 24 in each of the portrait to landscape configurations, as well as one or more intermittent angular orientations between the portrait and landscape orientations.

Figure 13:
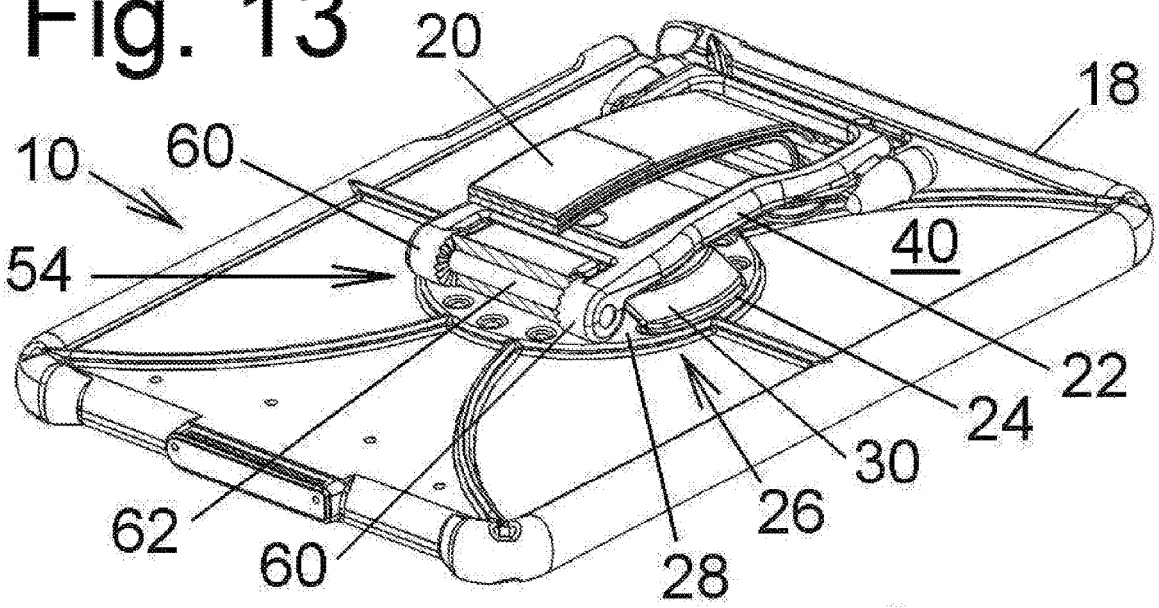
Figure 14:
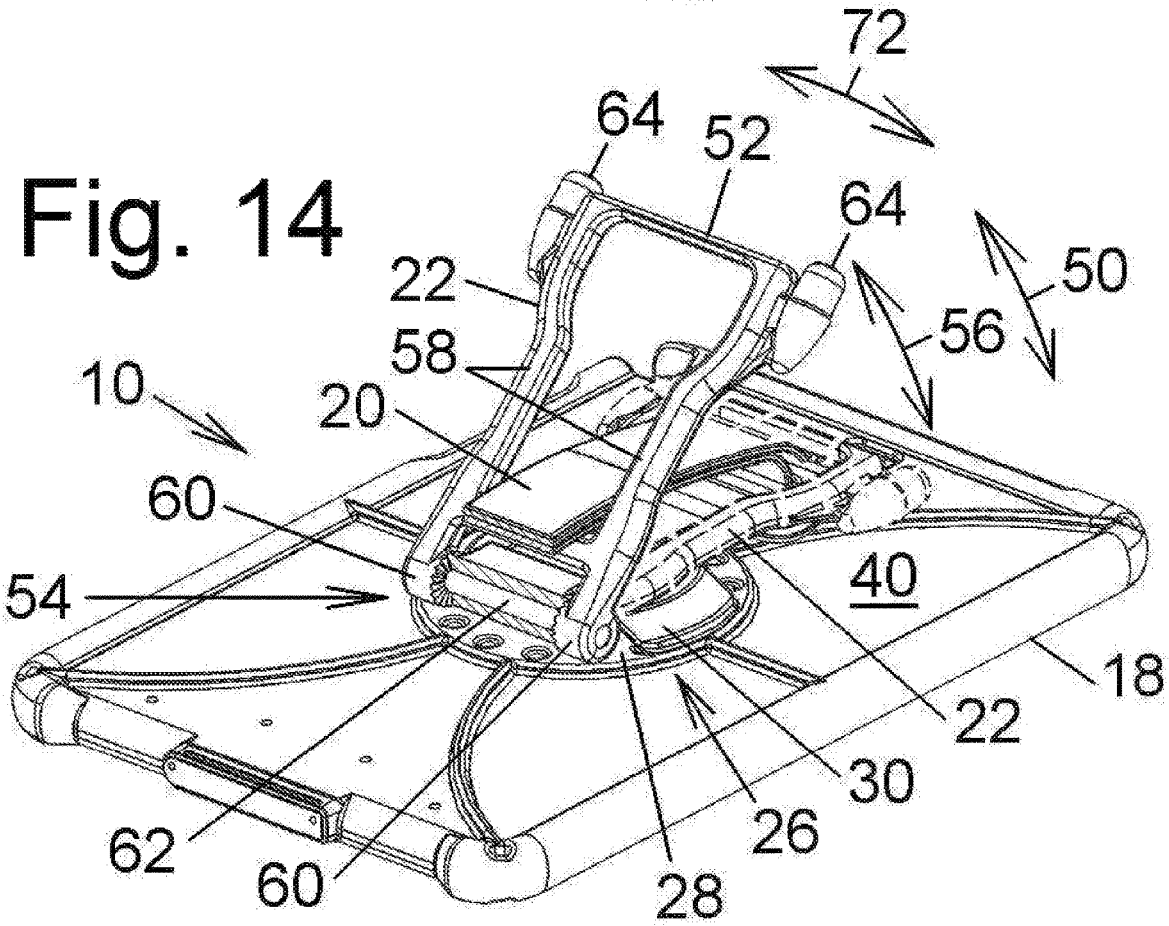

FIG. 13 and FIG. 14 together illustrate deployment of stand 22 for supporting electronic device 12 on external fixed surface S (FIG. 3 and FIG. 4). In FIG. 13 stand 22 is shown in a stowed position in a retracted state against exterior 40 of back plane 38 of case 18. In FIG. 14 stand 22 is deployed into an extended state that is spaced away from exterior 40 of back plane 38 of case 18. For example, stand 22 is swiveled, or rotated or pivoted away (arrow 50) from stowed position (phantom lines) into the deployed position, whereby a foot portion 52 of stand 22 is spaced away from back plane 38 of case 18. By example and without limitation, stand 22 is coupled to rotational member 30 of interlocking mechanism 26 by a swivel mechanism 54 that permits stand 22 to swivel to angles within a range of deployment angles 56, for example but not limited to, between about 0 degrees and 90 degrees. According to one exemplary embodiment of swivel mechanism 54, stand 22 includes a pair of arms 58 each terminated in a toothed member 60 that is swivelably coupled to rotational member 30 of interlocking mechanism 26. For example, a swivel pin 62 is press-fit in rotational member 30 with opposite end portions extended on opposite sides thereof, and toothed members 60 are slip-fit on either end portion of swivel pin 62.

As further illustrated here by example and without limitation, foot 52 of stand 22 includes one or more rests 64 that may be formed of a high-friction or non-skid material, such as rubber or elastomer, that resist sliding of stand 22 on a smooth surface S.

FIG. 15 and FIG. 16 together illustrate operation of one possible embodiment of swivel mechanism 54 that permits stand 22 to swivel between the stowed position (FIG. 13) and the deployed position (FIG. 14). According to the exemplary embodiment of swivel mechanism 54 wherein stand 22 includes a pair of arms 58 (FIG. 14) each terminated in a toothed member 60, toothed member 60 is interlockable with a mating toothed member 66 of rotational member 30. Optionally, arms 58 (FIG. 14) of stand 22 are resiliently flexible whereby arms 58 are flexible outwardly (arrow 68) for disengagement of toothed members 60 of stand 22 from mating toothed member 66 of rotational member 30. Slip-fit of toothed members 60 along swivel pin 62 permits toothed members 60 to disengage from mating toothed member 66 whereby arms 58 are flexed outwardly (arrow 68). As shown by example and without limitation in FIG. 15, during swiveling (arrow 50) of stand 22 on rotational member 30, when mating teeth of mating toothed members 60 and 66 are mutually inclined, mating toothed members 60, 66 operate as a two-directional ratchet mechanism with mating inclined teeth toothed members 60, 66 sliding over one another whereby arms 58 resiliently flex which permit toothed members 60 slide outwardly (arrow 68) along swivel pin 62. A restorative spring tension is developed between pair of arms 58 due to resilient outward flexion caused by outwardly (arrow 68) sliding of toothed members 60 during disengagement from mating toothed members 66.

Such ratchet-like mechanism is operable in each directional swivel (arrow 50) of stand 22 between the stowed and deployed positions.

FIG. 16 illustrates interlocking engagement of mating toothed members 60, 66, wherein restorative spring tension developed between pair of resiliently flexibility arms 58 by outward flexion (arrow 68) during disengagement of toothed members 60 from mating toothed members 66 (FIG. 15) drives resiliently flexible arms 58 inwardly (arrow 70) one toward another. Under inward restorative spring force of outwardly flexed arms 58, mating inclined teeth of interlockable toothed members 60, 66 slide inwardly (arrow 70) along swivel pin 62 into interlocking engagement. Accordingly, swivelable stand 22 is rotationally fixed at a selected angle within the range of deployment angles 56 relative to back plane 38 of case 18 and relative to rotational member 30 of interlocking mechanism 26.

Preferably, resilient flexible whereby arms 58 is such that nominal hand force (FIG. 14 at arrow 72) is sufficient to resiliently flex arms 58 outwardly (arrow 68) for sliding mating inclined teeth toothed members 60, 66 over one another outwardly (arrow 68) along swivel pin 62 for operating the two-directional ratchet mechanism, while restorative spring tension developed between pair of resiliently flexibility arms 58 is sufficient for sliding toothed members 60, 66 inwardly (arrow 70) along swivel pin 62 into interlocking engagement of mating inclined teeth.

Figure 17:
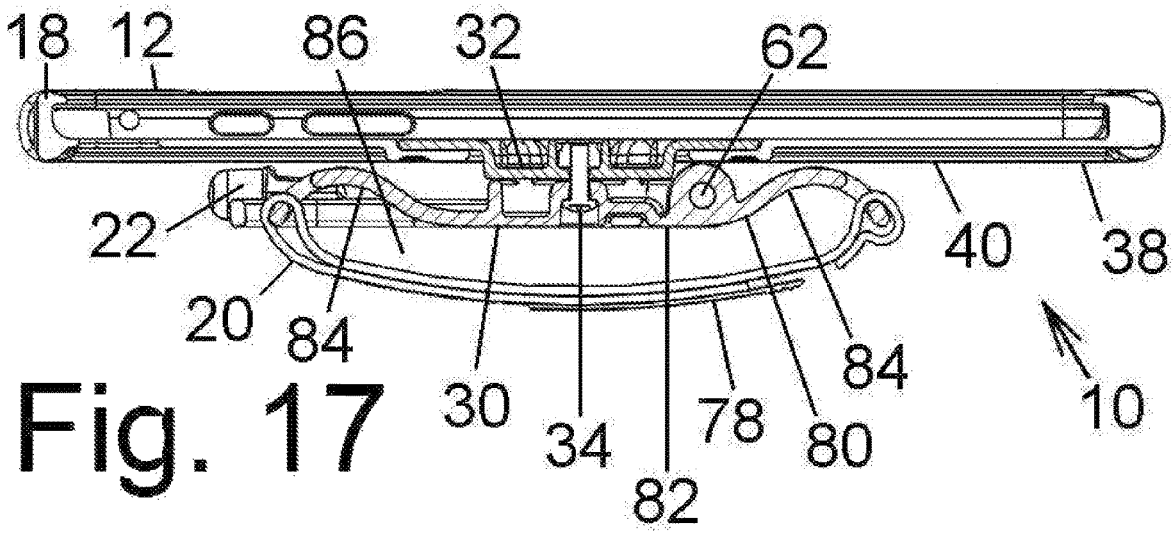
Figure 18:
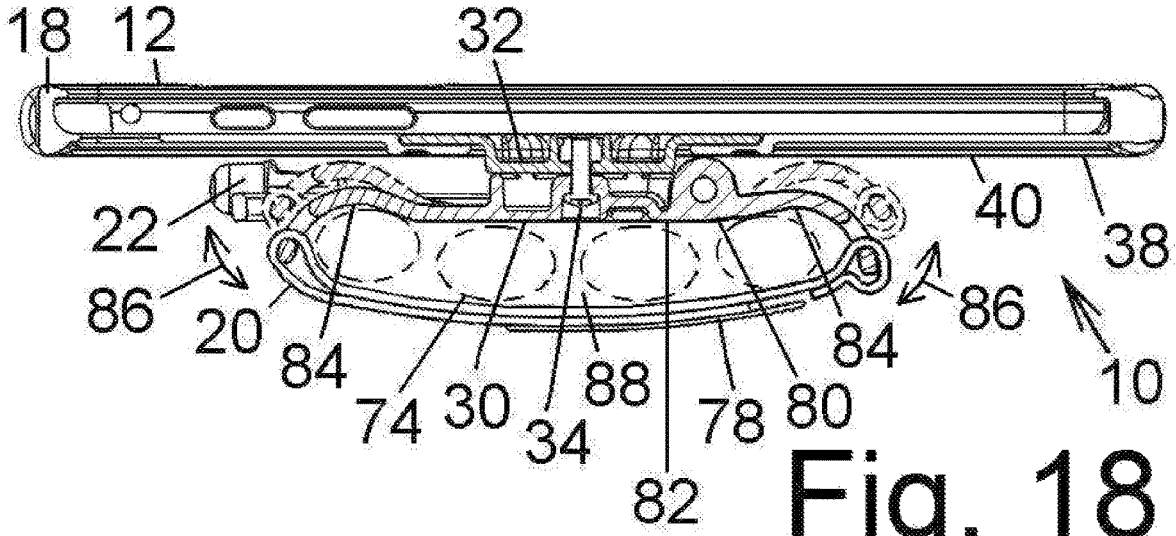
Figure 19:
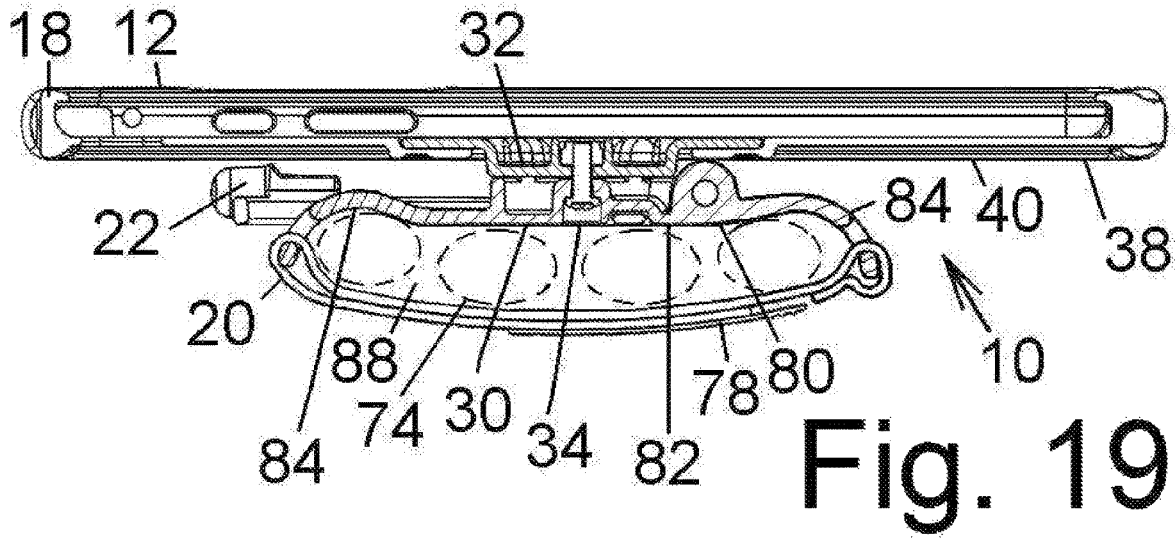

FIG. 17, FIG. 18 and FIG. 19 together illustrate operation of strap 20 attached to case 18 through rotational member 30 of interlocking mechanism 26 in base member 24 of support 10, and configured in a manner that permits fitting around an appendage 74 (phantom) of a user and allowing the user to support base member 24 of support 10 relative to user's appendage 74, for example, such as a user's hand, wrist or forearm, wherein user's appendage 74 is external and independent of both device 12 and inanimate object A. Strap 20 is optionally an elastic material that stretches to accommodate user's appendage 74 in a snug fit that stabilizes support 10 with device 12 relative to appendage 74.

However, strap 20 is optionally a substantially inelastic or unstretchable member with a length that is adjustable by means of a Velcro® other adjustable coupling 78, including but not limited to a buckle or a gear rack-and-ratchet zip-tie coupling. According to one embodiment, strap 20 is coupled to a frame 80 that is coupled to base member 24 for supporting electronic device 12 on appendage 74 in at least each of the portrait and landscape configurations for orienting device 12 with display screen 16 in each of the portrait mode (FIG. 5) and landscape mode (FIG. 6). For example, frame 80 is coupled to base member 24 independently of stand 22. Accordingly, by operation of interlocking mechanism 26 through base member 24, frame 80 is orientable at a plurality of different angles 48 between a first and a second angular orientation for orienting protective case 18 in each of the portrait orientation (FIG. 1) and the landscape orientation (FIG. 2), as discussed herein regarding stand 22.

Optionally, frame 80 is configured for flexing whereby strap 20 is expanded to accommodate user's appendage 74 while tightening in a snug fit that stabilizes support 10 relative to appendage 74. For example, frame 80 is formed with a curved or 'bow' shape, such as a reentrant curve as shown, wherein frame 80 is formed with two legs 82 on opposite sides of a central portion 84 that is coupled to rotational member 30 of interlocking mechanism 26, again substantially independently of stand 22. When the length of strap 20 has been adjusted to accommodate user's appendage 74, legs 82 of frame 80 are resiliently flexed outwardly (arrows 86) to receive user's appendage 74 into a loop 88 formed between strap 20 and frame 80, as shown.

A restorative spring tension is developed in legs 82 of frame 80 due to resilient outward flexion (arrows 86) during receiving of user's appendage 74 into loop 88. After appendage 72 is fitted into loop 88, relaxation of strap 20 releases the restorative spring tension developed in legs 82 of frame 80 by outward flexion (arrows 86), which restorative spring tension drives resiliently flexible legs 82 inwardly (arrows 86) toward back plane 38 of case 18. Under inward restorative spring force (arrows 86) of outwardly flexed legs 82, loop 88 of strap 20 rotate inwardly (arrows 86) tightening strap 20 in engagement with appendage 74. Accordingly, strap 20 grips appendage 74 to rotational member 30 of interlocking mechanism 26 and back plane 38 of case 18.

Figure 20:
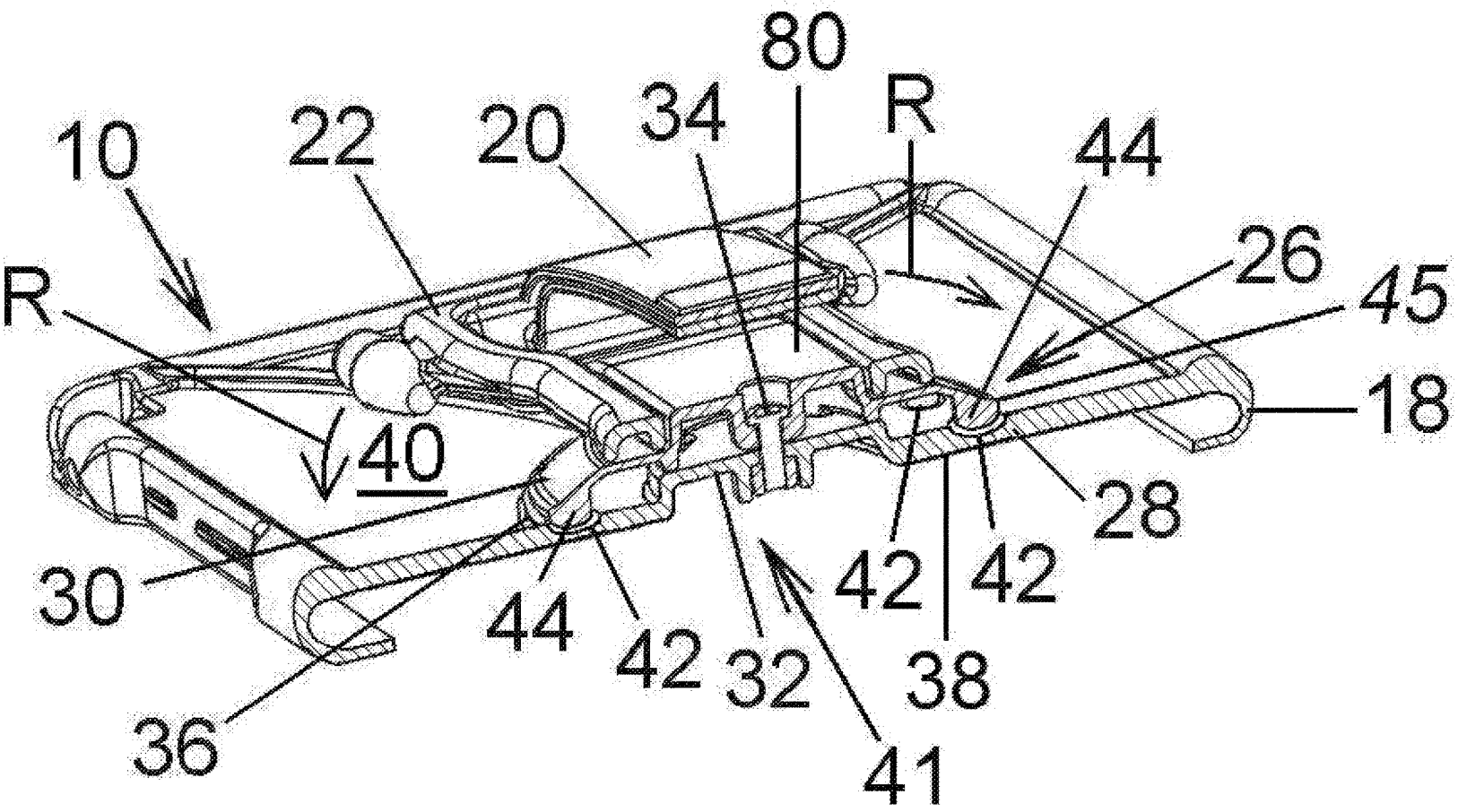
FIG. 20 illustrates the combination strap and fixed stand support of FIG. 1, wherein a retainer coupling the interlocking rotational mechanism to the case is eliminated, and the back plane of the protective case includes the interlocking rotational mechanism with the combination strap and stand of the support whereby the retainer is unnecessary.

FIG. 20 illustrates combination hand-strap 20 and stand 22 of support 10 for both tablets and other handheld portable electronic devices 12, wherein back plane 38 of case 18 incorporates nonrotational member 28 of interlocking mechanism 26 of support 10, and retainer 32 coupling interlocking rotational mechanism 26 to case 18 is incorporated into back plane 38 of case 18. Accordingly, interlocking rotational mechanism 26 is formed directly on back plane 38 of protective case 18 such that retainer 32 is offset relative to exterior 40 of case backplane 38. Nonrotational member 28 of interlocking mechanism 26 is incorporated into back plane 38 of protective case 18 such that array of receivers 42 in for mating with teeth 44 is formed directly in back plane 38 of case 18.

Rotationally interlocking mechanism 26, strap 20, and stand 22 operate as disclosed herein. Accordingly, interlocking mechanism 26 operates in relationship to back plane 38 as disclosed herein for rotationally fixing protective case 18 relative to back plane 38 in each of the portrait to landscape configurations, and optionally including one or more rotational orientations between the portrait to landscape configurations. Strap 20 coupled to resiliently flexible legs 82 of frame 80 operates in relationship to back plane 38 of protective case 18 as disclosed herein for accommodating user's appendage 74. Stand 22, including swivel mechanism 54 that permits stand 22 to swivel to angles within the range of deployment angles 56, operates in relationship to back plane 38 of protective case 18 as disclosed herein for supporting portable electronic device 12 in each of the portrait and landscape modes on external fixed surface S.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A support for a portable electronic device, the support comprising:

a case configured for receiving the portable electronic device;

a base positioned on the case and rotatable relative to the case, wherein the base comprises a frame, the frame comprising a first end and a second end opposite the first end;

a strap attached to the base and adjustable for fitting around an appendage of a user; and a support stand that is attached to the base independently of the strap and is swivelable with respect to the base between a stowed position and a plurality of deployed positions for supporting the support on an external surface in an angled arrangement in which the base and the support stand are joined together at a deployment angle different for each deployed position, wherein the strap is directly attached to the first and second ends of the frame and is configured to extend continuously from the first end to the second end of the frame in the stowed position and the deployed positions.

2. The support of claim 1, further comprising a rotational mechanism that is coupled to the base and case to provide for relative rotation between the base and the case.

3. The support of claim 2, wherein the rotational mechanism comprises a rotational member and a nonrotational member.

4. The support of claim 3, wherein one of the rotational member or the nonrotational member comprises a plurality of teeth and another of the rotational member or the nonrotational member comprises a plurality of receivers for mating with the teeth for fixing the rotational mechanism at a plurality of rotational orientations.

5. The support of claim 2, wherein the rotational mechanism is interlockable for fixing an orientation of the case relative to the base.

6. The support of claim 1, wherein the support stand comprises a swivel mechanism coupled to the base for swiveling the support stand within a range of the deployment angles relative to the base.

7. The support of claim 6, wherein the swivel mechanism is coupled to base at a position on the base so that the strap extends over at least a portion of the swivel mechanism.

8. The support of claim 1, wherein the support stand and the swivel mechanism each comprise at least one toothed member for mating to interlock the support stand and swivel mechanism at each of the deployment angles.

9. The support of claim 1, wherein the strap is inelastic.

10. The support of claim 1, wherein the support stand comprises two opposing arms having a fixed shape that is maintained in both the deployed positions and the stowed position.

11. The support of claim 10, wherein the support stand further comprises a rest attached to each of the two opposing arms, wherein each of the rests is formed of a high-friction or non-skid material that resists sliding of the support stand.

12. The support of claim 1, wherein the support stand is swivelable to any of the deployed positions without adjusting the strap from continuously extending between the first and second ends of the frame.

13. The support of claim 12, wherein the swivel mechanism is coupled to the base so that at least a portion the swivel mechanism is disposed between the base and the strap.

14. The support of claim 1, wherein the support stand and the frame each further comprise a portion of a swivel mechanism for swiveling the support stand within a range of the deployment angles relative to the base.

15. A support for a portable electronic device, the support comprising:

a case configured for receiving the portable electronic device;

a base positioned on the case and rotatable relative to the case;

a strap attached to the base and adjustable for fitting around an appendage of a user;

a support stand that is attached to the base independently of the strap and is swivelable with respect to the base between a stowed position and a plurality of deployed positions for supporting the support on an external surface in an angled arrangement in which the base and the support stand are joined together at a deployment angle different for each deployed position; and a resiliently flexible frame between the base and the strap.

16. The support of claim 15, wherein the resiliently flexible frame has a curved shape.

17. The support of claim 16, wherein the resiliently flexible frame comprises a central portion and two legs on opposite ends of the central portion.

18. The support of claim 17, wherein the two legs curve away from the central portion toward the case to produce a resilient outward flexion when the strap is fitted around the appendage of the user.

19. The support of claim 15, wherein the support stand comprises a swivel mechanism coupled to the base for swiveling the support stand within a range of the deployment angles relative to the base, wherein the strap and the resiliently flexible frame both extend over the swivel mechanism.

20. The support of claim 19, wherein the resiliently flexible frame comprises a central portion and first and second legs disposed on opposite ends of the central portion and the swivel mechanism is attached to the resiliently flexible frame at a position between, and spaced apart from, the first and second legs of the resiliently flexible frame.

* * * * *